US008141956B2

(12) United States Patent
Schouten et al.

(10) Patent No.: US 8,141,956 B2
(45) Date of Patent: Mar. 27, 2012

(54) CHAIR FOLDABLE FROM A SINGLE SHEET OF PLANAR MATERIAL

(75) Inventors: Thomas Maarten Schouten, Delft (NL); Douwe Jeichienus Jacobs, Delft (NL)

(73) Assignee: Technische Universiteit Delft, Delft (NL)

( * ) Notice: Subject to any disclaimer, the term of this patent is extended or adjusted under 35 U.S.C. 154(b) by 0 days.

(21) Appl. No.: 13/151,096

(22) Filed: Jun. 1, 2011

(65) Prior Publication Data

US 2011/0278899 A1 Nov. 17, 2011

Related U.S. Application Data

(63) Continuation of application No. PCT/NL2009/050725, filed on Nov. 30, 2009.

(30) Foreign Application Priority Data

Dec. 1, 2008 (NL) ..... 2002267
Apr. 1, 2009 (NL) ..... 2002696

(51) Int. Cl.
*A47C 7/02* (2006.01)

(52) U.S. Cl. ..... 297/440.12

(58) Field of Classification Search ..... 297/440.12
See application file for complete search history.

(56) References Cited

U.S. PATENT DOCUMENTS 3,295,890 A * 1/1967 Murdoch ..... 297/440.12 X
6,126,239 A * 10/2000 Hazzard ..... 297/440.12 X
6,629,734 B2 * 10/2003 Maoz ..... 297/440.12
2002/0043866 A1 4/2002 Maoz

FOREIGN PATENT DOCUMENTS

DE 2048605 5/1972
FR 2907645 5/2008

OTHER PUBLICATIONS

Leblois, Olivier J., "Conical Folding Mode for Fabricating, e.g., arm chair, transforms plastic sheets into furniture", FR 2907645 Abstract, May 2, 2008.

Koolwijk, Jan V., "Easily Collapsible Seat or Table—is folded from pre-shaped blank to give rigid side and walls", DE 2048605 Patent—Abstract, May 18, 1972.

* cited by examiner

*Primary Examiner* — Rodney B White
(74) *Attorney, Agent, or Firm* — Jeffrey D. Myers; Peacock Myers, P.C.

(57) ABSTRACT

Chair folded from a single sheet of planar material that is made to measure to a predefined contour cut, and that is provided with predefined first fold lines along which the material is bendable into a ready-to-use shape or form of the chair and wherein same is unfoldable to the original single sheet so as to facilitate the ease of storing and transportation of said chair.

11 Claims, 6 Drawing Sheets

CHAIR FOLDABLE FROM A SINGLE SHEET OF PLANAR MATERIAL

CROSS-REFERENCE TO RELATED APPLICATIONS

This application is a continuation application of International Patent Application Serial No. PCT/NL2009/050601, entitled "Chair Foldable from a Single Sheet of Planar Material", to Technische Universiteit Delft, filed on Nov. 30, 2009, and the specification and claims thereof are incorporated herein by reference.

This application is a continuation of Netherlands Patent Application Serial No. 2002267, entitled "Piece of Furniture and Method for Manufacturing Such a Piece of Furniture", filed on Dec. 1, 2008 and Netherlands Patent Application Serial No. 2002696, entitled "Piece of Furniture and Method for Manufacturing Such a Piece of Furniture", filed on Apr. 1, 2009, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The invention relates to a chair foldable from a single sheet of planar material, comprising a seat and optionally a backrest, wherein parts of the single sheet that are adjacent are connectable to each other, and which is provided with predefined first fold lines along which the material is bendable into a ready-to-use shape or form.

2. Description of Related Art

Such a chair with a back rest is known from FR-A-2,907,645. The invention is however also concerned with a chair that has no backrest, and which commonly is referred to as a stool. Wherever in this document mention is made of chair, this therefore also includes the concept of a stool.

A problem with the known chair is its lack of stability when the chair is folded into the ready-to-use shape or form. The known chair essentially comprises two cones, the tops of which have to rest upon each other in order for the chair to be able to support a sitting person.

A further problem with the known chair is its lack of durability, since a large section of the relatively delicate fold lines are in constant contact with the floor.

Still a further problem of the known chair is that, when folded flat, the dimensions of the cut-outs are very large, making them very cumbersome to handle.

Still a further problem is that the construction of the known chair requires a high degree of accuracy in order to be able to have the cones of the chair's two parts have their tops exactly meet each other when the chair is folded into the ready-to-use position.

BRIEF SUMMARY OF THE INVENTION

The invention has the objective to alleviate one or more of the above mentioned problems, and to attain advantages that will become apparent with the following description.

The chair of the invention is to this end embodied according to one or more of the appended claims.

BRIEF DESCRIPTION OF THE SEVERAL VIEWS OF THE DRAWINGS

The invention will hereinafter be further elucidated with reference to the drawing showing in.

Wherever in the s the same reference numerals are applied, these reference numerals apply to the same parts.

DETAILED DESCRIPTION OF THE INVENTION

Figure 1A:
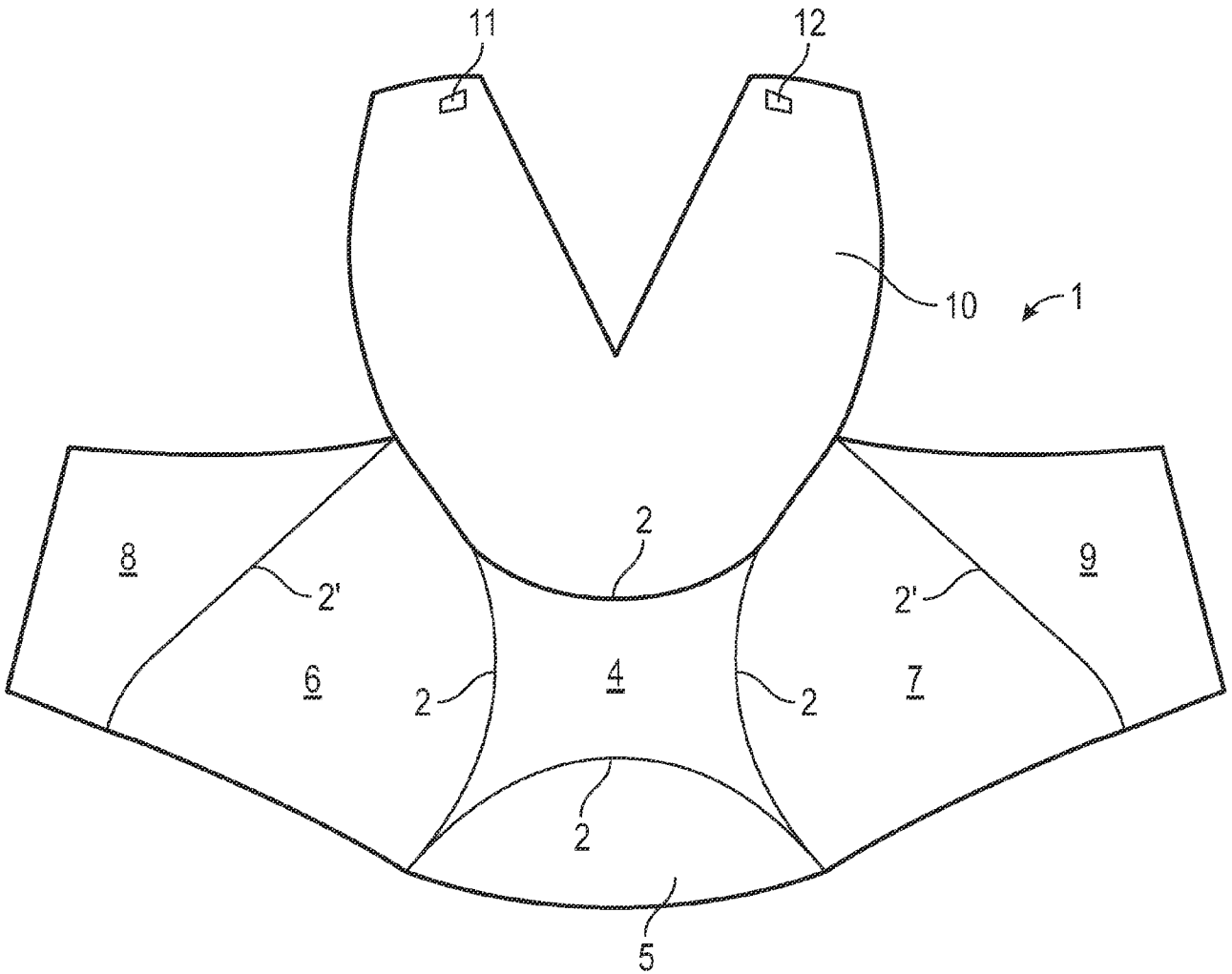
FIGS. 1A and 1B two embodiments of single sheet of planar material from which a chair in accordance with the invention is manufactured.

According to a first aspect of the invention the single sheet of planar material of the chair has four predefined first fold lines that are curved and which at their extremities merge into each other two by two so as to define between said four fold lines a first area, and that each of said predefined four fold lines borders and delimits at least one of a number of second areas from said first area, wherein this first area together with the second areas collectively embody the chair upon said areas being folded to the ready-to-use shape or form of the chair. Hence according to this first aspect of the invention the chair is foldable from a single sheet of planar material that is made to measure to a predefined contour cut, and that is provided with predefined first fold lines along which the material is bendable into a ready-to-use shape or form of the furniture. These first fold-lines are curved to support the strength of the furniture in its eventual shape or form. The said first area then provides the chair with the required (sideways) stability.

To attain low-cost and make assembly easy it is preferable that there are two second areas opposed to each other at opposite sides of the first area, which form lower side-parts of the ready-to-use chair that connect through a hinge to lower back-parts that are arranged to lock into each other upon the areas being folded to the ready-to-use shape or form of the chair. The said lower back-parts have the advantage that they promote strength of the construction of the chair, allowing that the chair can be used by people that are challenged by their weight.

Further, preferably at the same time that the previously mentioned feature is applied, at one side of the first area there is a second area that forms at least the seat and optionally the backrest of the ready-to-use chair, which is embodied with parts that are adjacent to each other when the areas are folded into the ready-to-use shape or form of the chair and that are distant from each other when the sheet is planar.

Low-cost and ease of assembly can further be promoted by arranging that the parts of the second area that are adjacent to each other at the backrest are provided with connecting means fastener.

Appropriately the parts of the second area that are adjacent to each other at the backrest are provided with a cooperating cut-out and protrusion that can hook into each other.

A further desirable aspect of the chair of the invention is that same is unfoldable to the original single sheet so as to facilitate the ease of storing and transportation of said chair.

Transportation is particularly easy by providing that same has predefined second fold lines that are straight and along which the material is bendable into a ready-to-carry shape of a case. This allows that the furniture can easily be taken along while travelling.

The method of manufacturing such a piece of furniture is based on the processing of a single sheet of planar material by providing the sheet with fold lines at predefined positions making said sheet to a predefined measure folding the sheet along the fold lines to the ready- to-use shape or form of the piece of furniture.

It is clear that the furniture and the method of its manufacturing in accordance with the invention is very cost-effective and easy to implement whereas a further advantage re-sides in that the chair is simply unfoldable to the original single sheet so as to facilitate its ease of storing and transportation in case transportation as a case is too cumbersome. The chair of the invention requires no additional structural support elements. It obtains its strength solely from the (curved) first foldlines in the single sheet. This gives the product of the invention several distinctive characteristics, among which: completely flat during production and if desired also during transportation (1-5 mm), robust, light, easy to product and customizable (i.e. printable as a flat sheet). Particularly this last-mentioned aspect is advantageous: due to the circumstance that the chair is made starting with a planar single sheet, it is very easy to customize it to the needs of the user by applying the required prints or cut-outs or other operations to said planar sheet.

To maintain the costs at a very low level it is further preferable that the single sheet is of a material selected from the group comprising cardboard, synthetic material. Surprisingly the chair can still maintain sufficient strength to withstand the day-to-day tear and wear due to even very intensive use.

It is preferred that the sheet is made to measure to a predefined contour cut by injection-moulding. It is however also possible to apply an operation selected from the group comprising cutting, punching.

It is further preferred that providing the sheet with fold lines is executed with an operation selected from a series of operations depending on the sheet's material, such that card-board sheet is provided with score-lines and synthetic material sheet is provided with grooves acting as living hinges.

As mentioned above, in order to facilitate the providing of a chair at low costs it is preferable that the chair is provided with at least a seat and optionally a backrest, wherein parts of the single sheet that are adjacent to each other (usually at the backrest), and that are distant from each other when the sheet is planar, are connectable to each other. The parts of the sheet that are adjacent to each other and that are to be connected to each other, can be realized in many different ways. It is in a first embodiment preferred that the parts of the sheet that are adjacent to each other (for instance at the backrest) are provided with connecting means selected from the group comprising Velcro, bolt and nut, click-fastener. In this way it is possible to maintain the low thickness-value of the sheet also for the parts that are to be connected to each other, maintaining thus that the furniture is easy to store and transport when it is folded back to its original form of a single sheet.

A second more preferred embodiment is, however, characterized in that the parts of the sheet that are adjacent to each other are provided with a cooperating cut-out and protrusion that can hook into each other. In this way no additional connecting means are required since the connecting means are simply a part of the material of the single sheet.

Figure 1B:
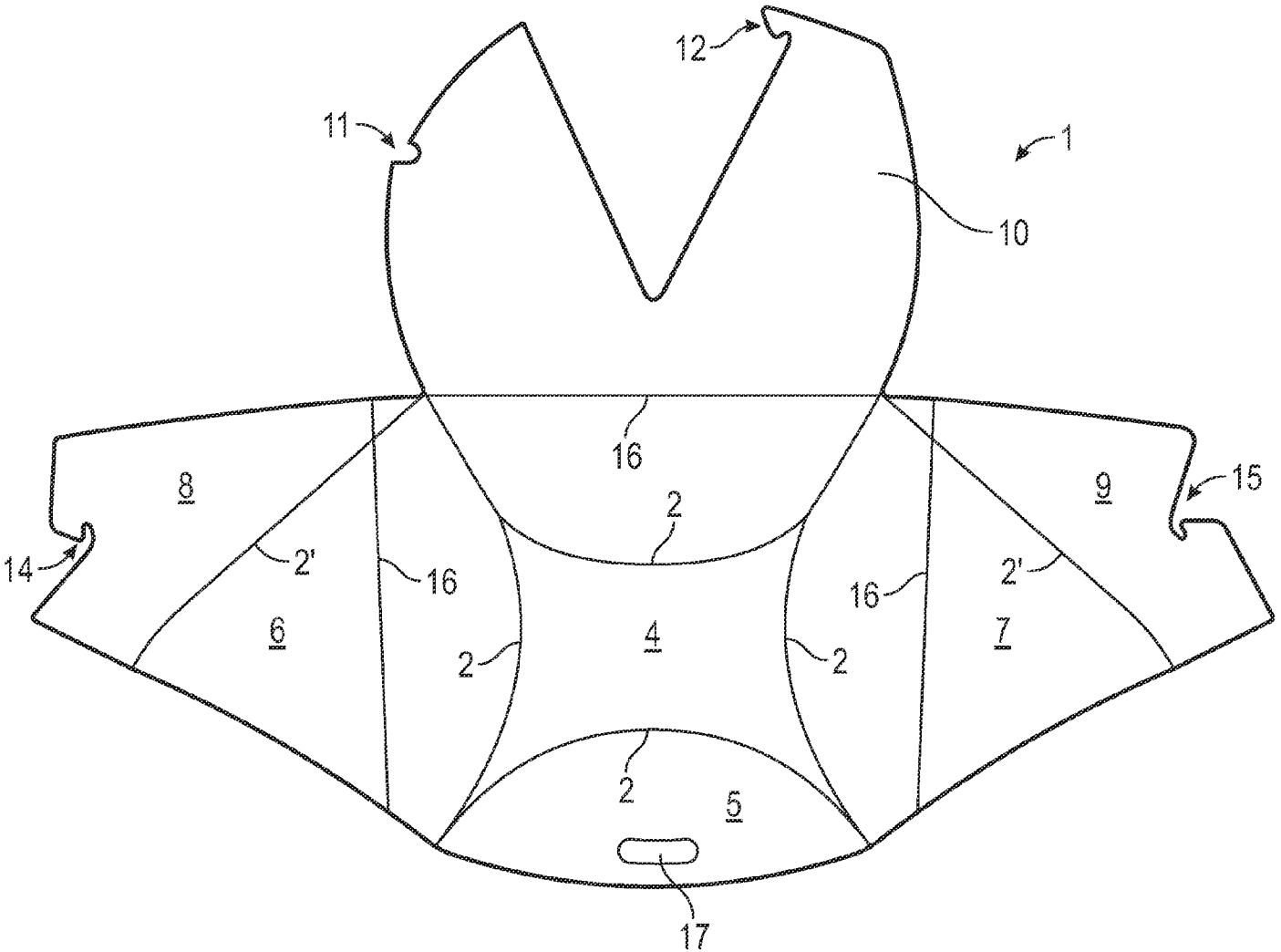

With reference first to FIGS. 1A and 1B, both s show a single sheet 1 of planar material, for instance cardboard or a synthetic material such as polypropylene. This sheet 1 is cut in a predefined shape and is provided with curved first fold lines 2, along which a chair 3 as shown in FIGS. 2A and 2B is folded out of the single sheet 1.

Figure 2A:
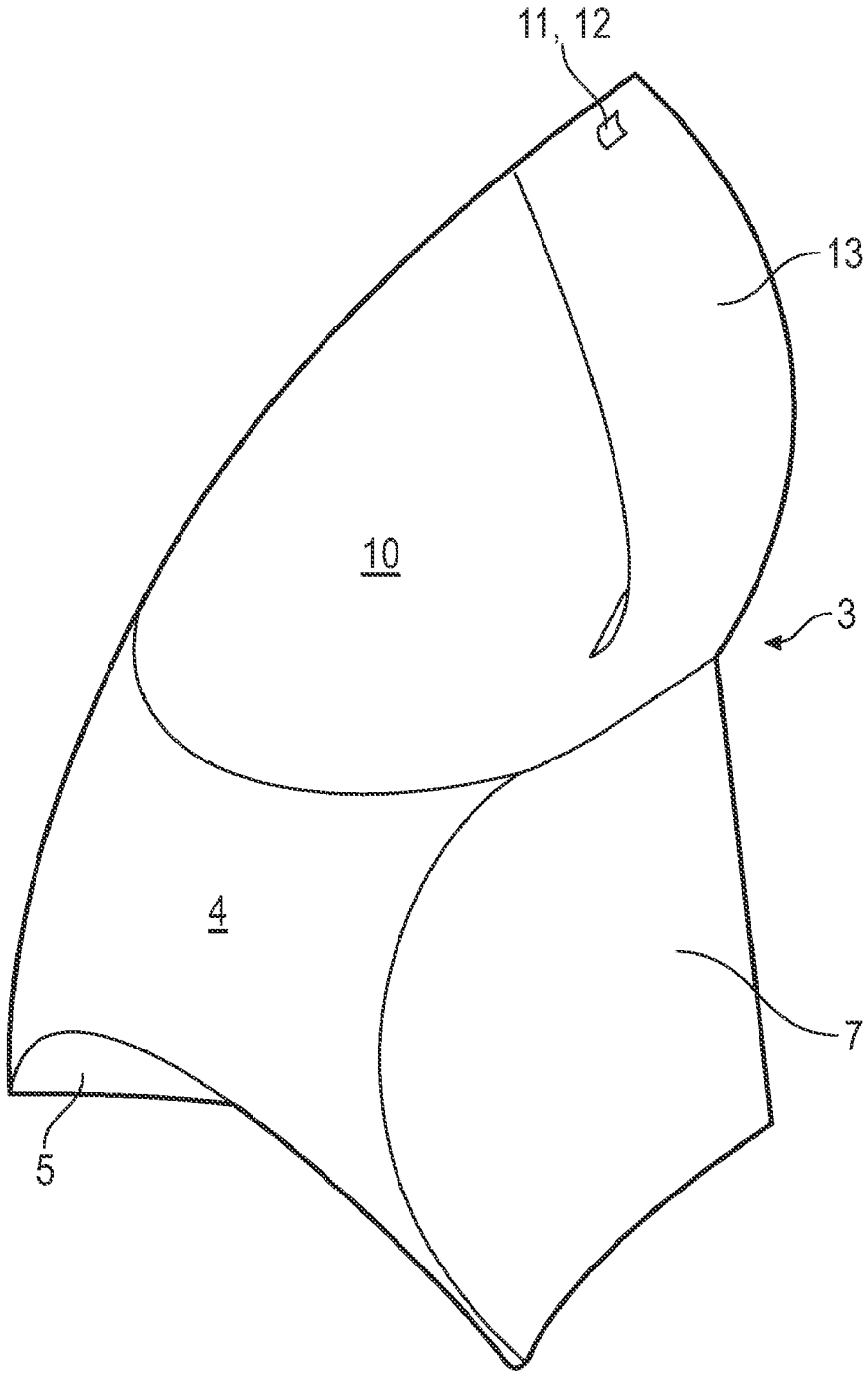
FIGS. 2A and 2B the chair of the invention made from the single sheets of FIG. 1A and FIG. 1B respectively.
Figure 2B:
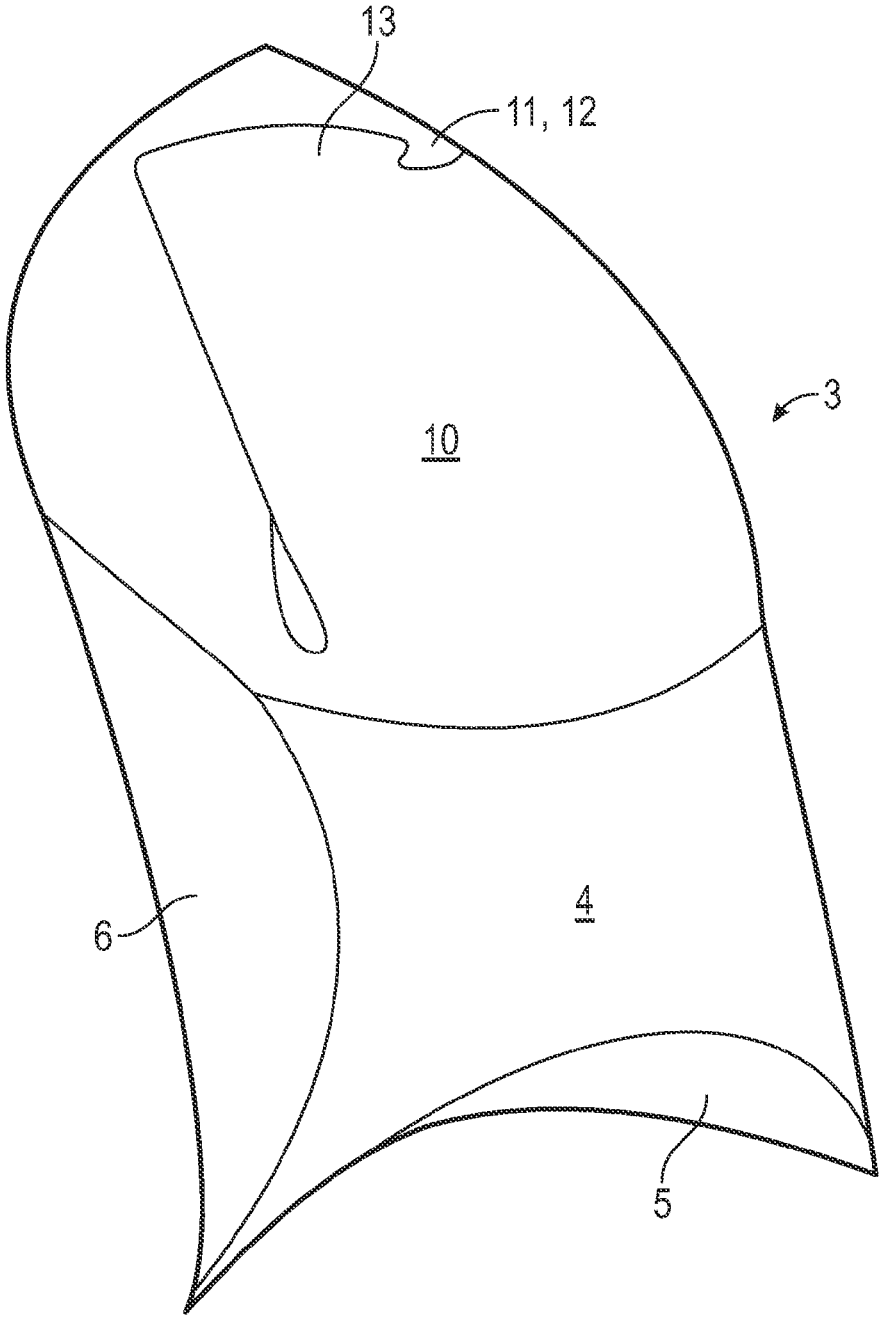

The fold lines 2 in the sheet 1 define preselected parts of the chair 3 as shown in FIGS. 2A and 2B when it is in its eventual shape or form. For instance a frontal lower part of the chair 3 is indicated with reference numeral 4, a bottom part of the chair 3 is in indicated with reference numeral 5, the lower side parts are indicated with reference numerals 6 (FIG. 2B) and 7 (FIG. 2A), the lower back parts that connect with the lower side parts 6, 7 with hinges 2' are provided with reference numerals 8 and 9, and the seat and the optional back-rest parts are collectively indicated with reference numeral 10.

In FIG. 1A and FIG. 1B with reference numeral 11 and 12 reference is made to the parts of the sheet 1 that eventually come to lie adjacent to each other at the position of the back rest 13 as shown in FIGS. 2A and 2B. In FIG. 1A and FIG. 2A there reference numerals 11 and 12 refer to connecting means that are provided in the sheet 1 and that are selected from the group comprising Velcro, a bolt and nut, or a click-fastener. In FIG. 1B and FIG. 2B the reference numerals 11 and 12 refer to connecting means embodied as a cooperating cut-out 11 and protrusion 12 in the back rest part 13. FIG. 1B further shows that in this embodiment the lower back parts 8, 9 are provided with cutouts 14, 15 that are intended to cooperate when the single sheet of FIG. 1B is converted into its ready-to-use shape of a chair as shown in FIG. 2B. This will be explained further hereinafter.

The embodiment of FIG. 1B shows that in comparison with the embodiment shown in FIG. 1A, the FIG. 1B-*embodiment* is provided with additional second fold lines 16 that are straight and that are intended to convert the shown single sheet of material by bending it along said second fold lines 16 into a ready-to-carry shape of a case in order to easily carry the case. The sheet 1 is therefore also provided with a handgrip 17.

The conversion of the piece of furniture being shaped in the form of a ready-to-carry case into the form of a ready-to-use chair is shown in the series of figures of FIG. 3A to FIG. 3H.

Figure 3A:
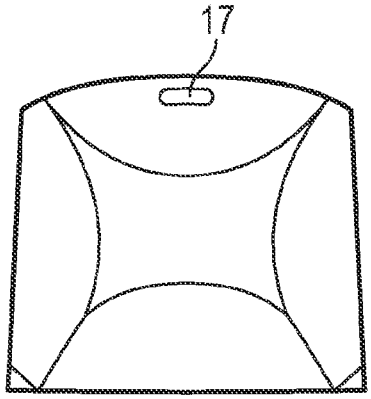
FIG. 3A-FIG. 3H show the conversion of the piece of furniture shaped as a case into the form of a ready- to-use chair.

FIG. 3A shows the piece of furniture as a case having the handgrip 17 on top. An aspect of the design of the invention is that this handgrip 17 which is provided for use of same when it is converted to a case, allows that the case can easily be handled. The handgrip 17 is however not visible when same is converted to a chair.

Figure 3B:
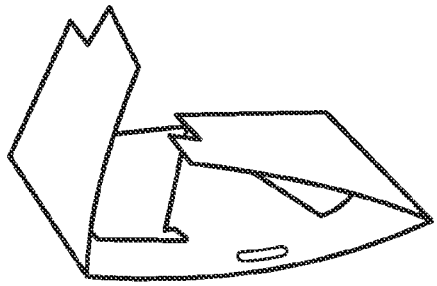
Figure 3C:
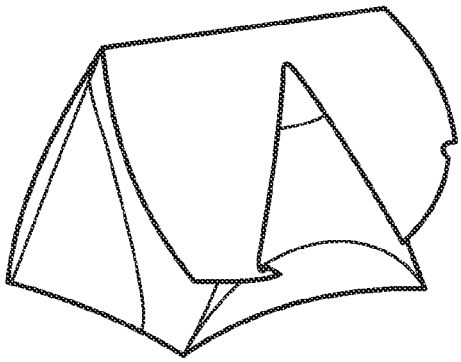

In FIG. 3B the case of FIG. 3A is being unfolded and in FIG. 3C the lower part of the chair-to-be is placed on the ground.

Figure 3D:
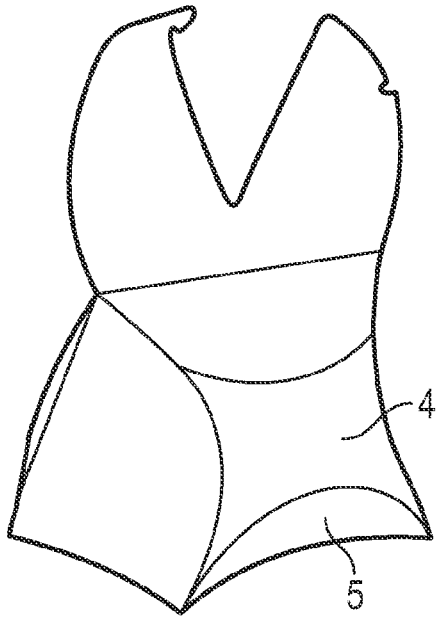
Figure 3E:
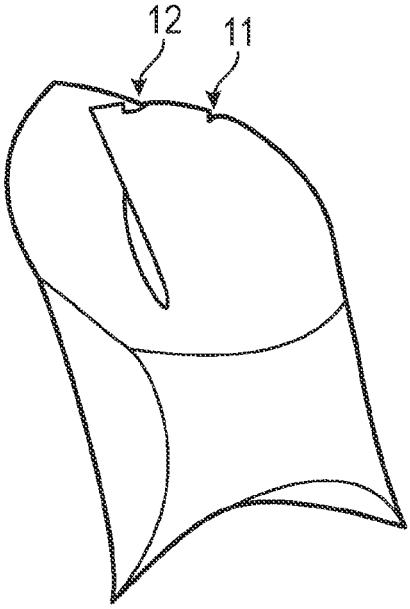
Figure 3F:
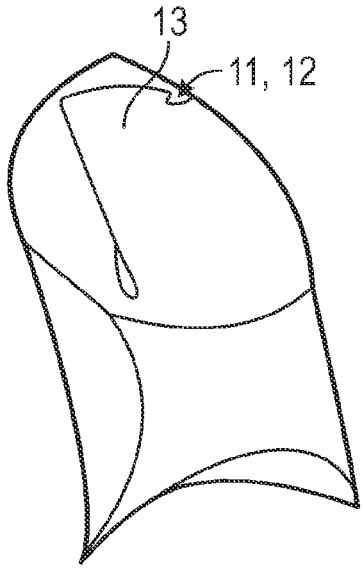

FIG. 3D shows that the backrest-to-be is lifted from the lower part and in FIG. 3E and FIG. 3F the completion of the backrest-portion 13 is shown in which the cut-out 11 and protrusion 12 are cooperating to complete their connection.

Figure 3G:
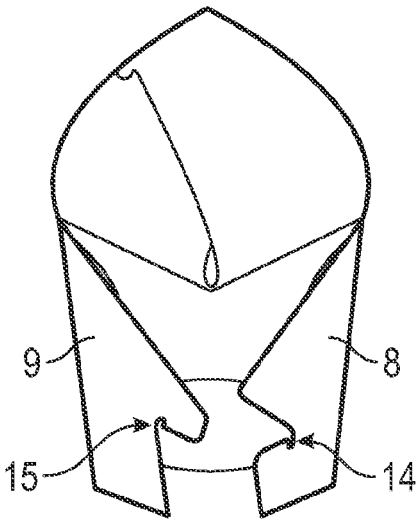
Figure 3H:
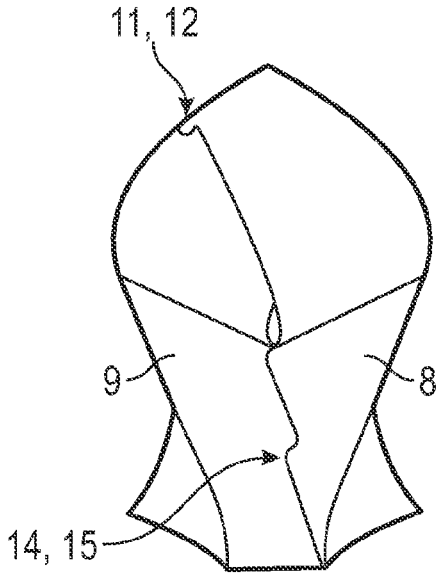

FIG. 3G shows that thereafter the connection of the lower back-parts 8, 9 can be accomplished by locking into each other the cut-outs 14, 15 after which FIG. 3H shows the back side of the ready-to-use chair.

It is clear that the sheet 1 as shown in FIGS. 1A and 1B can be very thin in the order of 1-5 mm, and that numerous sheets 1 can be stacked in order to store or transport multiple foldable chairs 3 of the invention whilst only very little space is used therefore.

What is claimed is:

1. Chair foldable from a single sheet of planar material, comprising a seat, wherein parts of the single sheet that are adjacent are connectable to each other, said sheet being provided with predefined first fold lines along which the material is bendable into a ready-to-use shape or form, wherein there are four predefined first fold lines that are curved and which at extremities thereof merge into each other two by two so as to define between said four fold lines a first area, and wherein each of said four predefined first fold lines borders and delimits at least one of a number of second areas from said first area, and a third area provided at one side of the first area that forms the seat of the ready-to-use chair, wherein this first area together with the second areas and the third area collectively embody the chair upon said areas being folded to the ready-to-use shape or form of the chair, and wherein the sheet is embodied with parts that are adjacent to each other when the first, second, and third areas are folded into the ready-to-use shape or form of the chair and that are distant from each other when the sheet is planar.

2. Chair according to claim 1, wherein there are two second areas opposed to each other at opposite sides of the first area which form lower side-parts of the ready-to-use chair, the lower side-parts including lower back-parts hingedly connected to the lower side-parts, the lower back-parts being arranged to lock into each other upon the lower side-parts being folded to the ready-to-use shape or form of the chair.

3. Chair according to claim 1, wherein the parts of the third area that are adjacent to each other when the first, second, and third areas are folded into the ready-to-use shape or form of the chair are provided with connecting means selected from the group consisting of hook and loop fastener, bolt and nut, and click-fastener.

4. Chair according to claim 3, wherein the parts of the third area that are adjacent to each other are provided with a cooperating cutout and protrusion that can hook into each other.

5. Chair according to claim 1, wherein said chair is unfoldable to the original single sheet so as to facilitate the ease of storing and transportation of said chair.

6. Chair according to claim 1, wherein said sheet is provided with predefined second fold lines that are straight and along which the material is bendable into a ready-to-carry shape of a case.

7. Chair according to claim 1, wherein the single sheet is of a material selected from the group consisting of cardboard and synthetic material.

8. Chair according to claim 7, wherein the material is cardboard and the fold lines are score-lines.

9. Chair according to claim 7, wherein the material is synthetic and the fold lines are grooves so as to result in living hinges.

10. Chair according to claim 1 additionally comprising a backrest.

11. Chair according to claim 10 wherein the second area forms the seat and the backrest.

* * * * *